United States Patent [19]

Santilli

[11] Patent Number: 4,628,895

[45] Date of Patent: Dec. 16, 1986

[54] KILN AND AUTONOMOUS HEAT SOURCE PORTABLE INTEGRATED UNIT

[76] Inventor: Giovanni Santilli, Via S.Donato, 109, 61029 Urbino (Pesaro), Italy

[21] Appl. No.: 683,413

[22] Filed: Dec. 19, 1984

[30] Foreign Application Priority Data

Jan. 24, 1984 [IT] Italy ..... 3314 A/84

[51] Int. Cl.[4] ..... F24B 3/00; F27B 3/02; F24C 1/16

[52] U.S. Cl. ..... 126/25 R; 126/9 R; 432/158; 432/120

[58] Field of Search ..... 432/120, 156, 158, 225, 432/226, 227, 247, 249, 245; 126/25 R, 9

[56] References Cited

U.S. PATENT DOCUMENTS

| | | | |
|---|---|---|---|
| 223,007 | 12/1879 | Koester et al. | 432/158 |
| 325,617 | 9/1885 | Machlet | 432/158 |
| 590,214 | 9/1897 | Dall | 432/120 |
| 644,270 | 2/1900 | Baumann | 432/158 |
| 756,561 | 4/1904 | Bacon | 432/120 |
| 1,357,494 | 11/1920 | Gaskill | 432/158 |
| 1,583,311 | 5/1926 | Reid | 432/158 |
| 2,784,957 | 3/1957 | Hardtmayer, Jr. | 432/249 |
| 3,282,578 | 11/1966 | Ulbrich | 432/120 |
| 3,752,643 | 8/1973 | Robinson | 432/247 |
| 4,474,165 | 10/1984 | Richardson | 432/249 |

*Primary Examiner*—Henry C. Yuen

*Attorney, Agent, or Firm*—Laff, Whitesel, Conte & Saret

[57] ABSTRACT

Disclosed herein is an invention that belongs to the technical field of equipment destined to hobby use and, in particular, relates to a portable kiln and heat source integrated unit. The invention envisages there being a combination of: a portable kiln with a firemouth positioned at the bottom of the said kiln; a support structure able to set the kiln in a removable fit-lock way on a burner facing the said firemouth; and heat insulating means of protection designed to safeguard at least the elements placed adjacent to the said firemouth.

1 Claim, 1 Drawing Figure

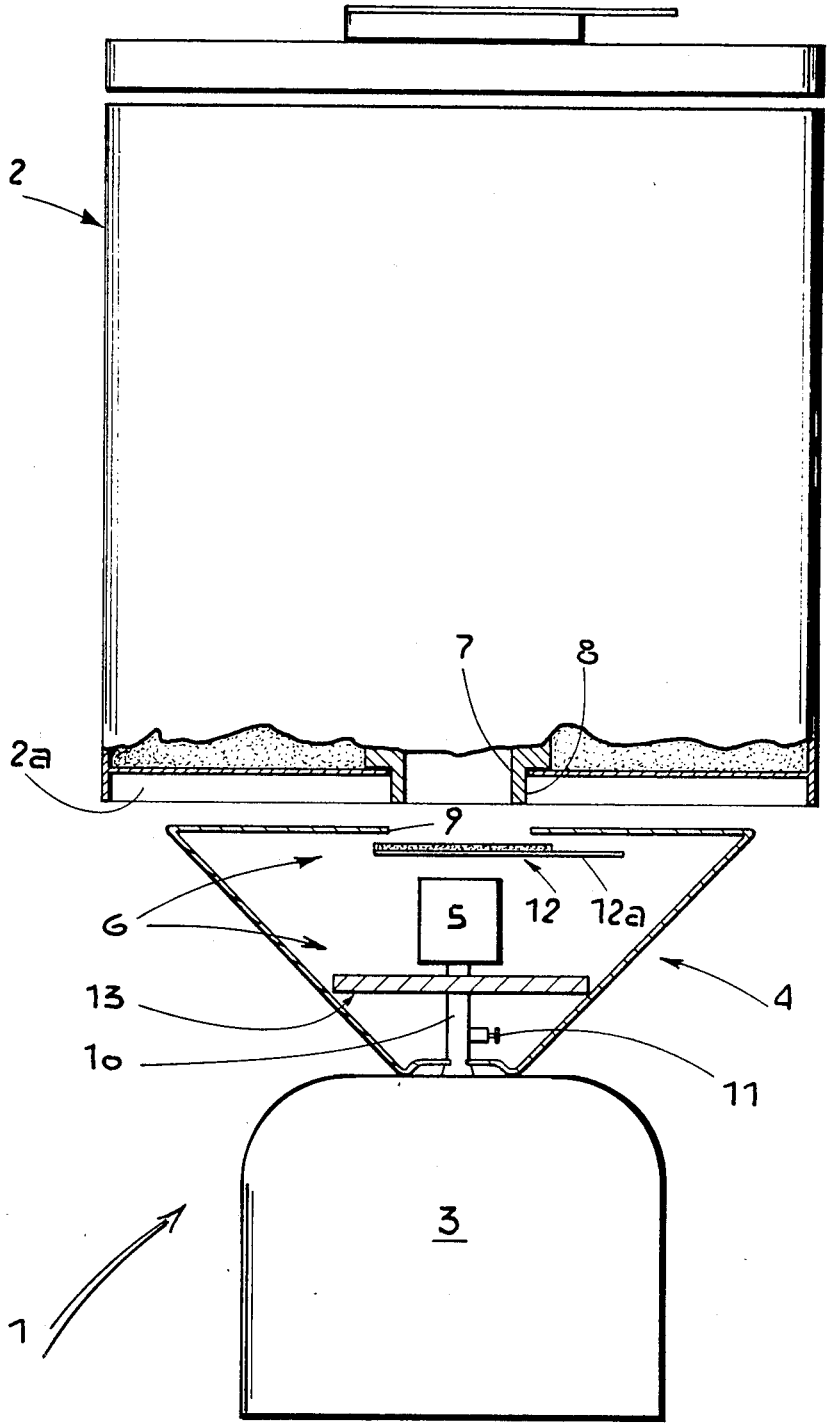
2
7
8
2a
9
6
5
12
12a
13
4
10
11
3
1

KILN AND AUTONOMOUS HEAT SOURCE PORTABLE INTEGRATED UNIT

BACKGROUND OF THE INVENTION

The invention relates to a portable kiln and heat source integrated unit meant essentially for hobby use, for example: for firing ceramics and enamels, melting small quantities of metal, and baking bread, pizza pies and the like.

DESCRIPTION OF THE PRIOR ART

All kilns of a capacity of up to 100–200 liters on the market at the present time are electric. Over 200 liters, the kilns now on sale are either electric or gas operated (butane, propane, methane etcetera).

Not only are the gas kilns of relatively large dimensions but they also have a non-removable structure in which the flame formation zone is separate from the source of energy, for example the gas mains. For this purpose, metal or rubber connecting pipes are provided.

In practice, small size kilns are solely electric and this creates a series of problems that limit the diffusion of the kilns towards their natural users, namely people who intend to utilize the said kilns for occasional, generally non-professional, purposes.

The said problems are: the high running cost, connected with the consumption of electricity, and the need to depend on the electrical network.

This final limitation prevents the kilns from being used out in the open or at times in places such as cellars, attics and garages which, in themselves, are suited to this type of operation.

The limitations to which reference has just been made stem in part from the conviction that in order to safeguard the users, it is necessary to resort to a source of energy (electricity) that is virtually insensitive to the heat generated by these kilns. This strong belief has led, as stated previously, to gas-run kilns being solely non-portable, large size kilns, with the source of energy clearly separate from the flame formation zone.

However, it is obvious that for non-professional use gas ovens are definitely advantageous, in comparison with kilns that are dependent on the electrical network, as regards cheapness and energetical self-sufficiency.

SUMMARY OF THE INVENTION

In view of the said situation, the general object of the invention is to create a portable kiln and heat source integrated unit with which the above mentioned problems can be overcome.

Within the framework of this general purpose, one important object of the invention is to devise a kiln which, though being gas operated and having a portable structure, is fully reliable as regards the safety of the users.

Another important object of the invention is to devise an integrated unit that is easy to assemble and dismantle and, at least in part, is made up of parts commonly available on the market.

These purposes and others that will become more apparent below are achieved with the portable kiln and heat source integrated unit, characterized by comprising: a portable kiln virtually the size of a can, provided with at least one firemouth able to receive a flame, positioned in the region of the lowest part of the said kiln; a support structure able to fit at least the said lowest part of the said kiln and to set it, in a removable fit-lock way, on a burner facing the said firemouth; and heat insulating means of protection designed to safeguard at least the elements placed adjacent to the said firemouth.

Advantageously, the said burner is a "Bunsen burner" supplied, via a pipe provided with a cut-off cock, with fuel contained in a portable type cylinder connected to the said pipe; the said cylinder forming a portable unit together with the said kiln, the said support structure, and the said means of protection.

BRIEF DESCRIPTION OF THE DRAWING

Further characteristics and advantages will be seen more clearly from the description that follows of one preferred, but not sole, embodiment for the invention, illustrated purely as an example on the accompanying drawing, in which the one and only FIGURE shows in an overall partially exploded, partly plan and partly sectional view, the unit according to the invention.

DESCRIPTION OF THE PREFERRED EMBODIMENT

With reference to the said FIGURE, the unit according to the invention is shown globally at 1.

Comprised therein is a portable kiln 2, a cylinder 3 also of portable type, a support structure 4 interposed between the kiln 2 and the cylinder 3, a burner 5 supplied by the cylinder 3, and heat insulating means of protection 6 interposed between the kiln 2 and the cylinder 3.

The kiln 2, of portable type, is virtually the size of a can and, insofar as the invention described herein is concerned, is provided with one firemouth 7 that is able to receive a flame and is positioned in the center of the kiln 2 bottom part **2*a***.

An asset of the invention is that the firemouth 7 has an annular end piece 8 protruding from the lowest part **2*a* that fits into an opening 9 in the top of the support structure 4, in a removable fit-lock way. The said support structure 4 rises directly above the cylinder 3** onto which it is fitted in a removable fashion.

The burner 5 is constituted by a "Bunsen burner" and is supplied by the cylinder 3 via a pipe 10 provided with a cut-off cock 11.

The cylinder 3, of portable type, is preferably a typical camping cylinder and, in practice, this, the support structure 4 and the kiln 2 define a portable unit in which all the parts are fitted one into the other, in a removable fashion.

The means of protection 6 can be shaped and arranged in various ways, though preferably they are plates formed by a thin metal plate and a layer of fiber, the latter facing the kiln 2.

A first plate 12, positioned immediately beneath the aperture 9, overhead of the burner 5, is visible in the FIGURE. The said first plate is removable and is provided with, for example, a handle **12*a***.

Fixedly inserted in the support structure 4, underneath the burner 5, is a second plate 13. The said second plate can be of various sizes and even be continued until the cylinder 3 is enshrouded.

The operation of the unit forming the subject of the invention, described above in a prevalently structural sense, is as follows.

The kiln 2 is loaded and got ready in accordance with a suitable procedure that is not pertinent to the invention, and is then superposed on the support structure 4 is a removable fit-lock way. The fitting is a result of the annular end piece 8 of the firemouth 7 being inserted, in a position facing the burner 5, into the aperture 9. The first protection plate 12 is in the removed position and, therefore, the burner 5 sends the flame directly into the inside of the firemouth 7.

The support structure 4 slots in and rests directly on the cylinder 3 and, furthermore, extends around the aperture 9 in such a way as to support, over an ample area, the lowest part 2*a* of the kiln 2.

The burner 5 is ignited in a way in itself known, the flame is inserted in the firemouth 7 and the kiln 2 is brought to the required temperature. During these operations, the second plate 13 protects the cylinder 3, as well as the pipe 10 and the cock 11, against radiation of the heat produced. The burner 5 is not subject to excessive thermal shock since the flow of heat generated there from tends to rise.

Once the required temperature has been reached, the kiln 2 is kept hot and static for the time needed to complete the desired thermal process. In this situation, heat capable of damaging the burner 5 can radiate downwards from the firemouth 7 and so the first plate 12 is then inserted between the firemouth 7 and the burner 5.

The complete thermal process within the kiln 2 can be carried out under maximum safety conditions, even if the cylinder 3 is positioned close to the kiln 2.

The unit 1 is altogether formed of a simple structure, takes up little room, is easily transportable and, above all, is fully self-sufficient as regards a heat source. Thus it can be used anywhere and, in particular, outdoors.

To conclude, stress is laid on the fact that the use of an ordinary camping cylinder for the cylinder 3 makes it easily available and reduces the initial cost since, in practice, a user can limit himself to buying just the kiln 2 with the relative support structure 4.

The invention as described is liable to undergo numerous modifications and variants, and all parts may be substituted with other technically equivalent elements.

What is claimed is:

1. A portable integrated kiln and autonomous heat source unit, structured in a vertical sequence as combined elements, comprising:

a can-shaped kiln having a bottom having a protruding annular end piece defining a firemouth;

a portable gas cylinder or small gas bottle set under the kiln; and a support structure positioned vertically beneath said kiln and connected to said gas cylinder, said support having an opening at its top adapted to removably engage said protruding annular end piece so that the kiln and gas cylinder can each be carried separately or together as an integrated unit;

a burner attached to said gas cylinder vertically facing said firemouth located under the opening in the support structure, the burner fed by fuel from said gas cylinder; and at least one heat insulating plate device connected to the support structure and set between the burner and the cylinder; and a second heat insulating plate device adapted to be positioned between the burner and the kiln firemouth when the desired kiln temperature has been reached and the kiln remains mounted on the support structure.

* * * * *